US010808359B2

(12) United States Patent
Tolfsson et al.

(10) Patent No.: US 10,808,359 B2
(45) Date of Patent: Oct. 20, 2020

(54) METHOD FOR MAKING TISSUE PAPER

(71) Applicant: VALMET AKTIEBOLAG, Sundsvall (SE)

(72) Inventors: Karl-Johan Tolfsson, Forshaga (SE); Jan Paulsson, Kil (SE); Goeran Ekstroem, Vaese (SE); Joakim Aronsson, Kil (SE)

(73) Assignee: Valmet Aktiebolag, Sundsvall (SE)

( * ) Notice: Subject to any disclaimer, the term of this patent is extended or adjusted under 35 U.S.C. 154(b) by 0 days.

(21) Appl. No.: 16/471,316

(22) PCT Filed: Dec. 12, 2017

(86) PCT No.: PCT/EP2017/082369
§ 371 (c)(1),
(2) Date: Jun. 19, 2019

(87) PCT Pub. No.: WO2018/114467
PCT Pub. Date: Jun. 28, 2018

(65) Prior Publication Data

US 2019/0316296 A1 Oct. 17, 2019

(30) Foreign Application Priority Data

Dec. 19, 2016 (SE) ..... 1651680

(51) Int. Cl.
*D21F 11/00* (2006.01)
*D21F 3/02* (2006.01)
*D21F 3/04* (2006.01)

(52) U.S. Cl.
CPC ..... *D21F 11/006* (2013.01); *D21F 3/0218* (2013.01); *D21F 3/0281* (2013.01); *D21F 3/045* (2013.01)

(58) Field of Classification Search
CPC ..... D21F 11/006; D21F 3/0281; D21F 3/045; D21F 3/0218; D21F 3/0209; D21F 5/02; D21F 5/182; B31F 1/126; B31F 1/12
See application file for complete search history.

(56) References Cited

U.S. PATENT DOCUMENTS 5,375,790 A 12/1994 Svanqvist
5,845,868 A 12/1998 Klerelid et al.
(Continued)

FOREIGN PATENT DOCUMENTS

EP 2085513 B1 9/2011
EP 2126203 B1 6/2012
(Continued)

OTHER PUBLICATIONS

International Searching Authority, International Search Report and Written Opinion for International Application No. PCT/EP2017/082369, dated Mar. 12, 2018, 9 pages, The Netherlands.

*Primary Examiner* — Jose A Fortuna
(74) *Attorney, Agent, or Firm* — Alston & Bird LLP

(57) ABSTRACT

A method of making tissue paper is provided, in which a fibrous web is formed in a forming section and transferred to a Yankee drying cylinder in a non-dewatering transfer nip formed between the Yankee drying cylinder and a shoe roll. The shoe roll has a shoe that is deformable such that it can adapt to a cylindrical outer surface of the Yankee drying cylinder, and a rotatable flexible jacket arranged to run in a loop around the shoe. A structured carrier fabric runs around the shoe roll and has land areas and void areas facing the fibrous web. The length of the transfer nip is in the range of 30 mm -100 mm and the linear load in the transfer nip is in the range of 35 kN/m-120 kN/m. The peak pressure in the transfer nip lies in the range 2 MPa-8 MPa.

10 Claims, 10 Drawing Sheets

(56) References Cited

U.S. PATENT DOCUMENTS

| | | | | |
|---|---|---|---|---|
| 6,398,916 | B1 | 6/2002 | Klerelid | |
| 6,488,816 | B1 * | 12/2002 | Klerelid | D21F 3/0281 162/296 |
| 6,547,924 | B2 | 4/2003 | Klerelid et al. | |
| 6,790,315 | B2 * | 9/2004 | Klerelid | D21F 3/0281 162/109 |
| 7,493,012 | B2 | 2/2009 | Green | |
| 7,527,708 | B2 | 5/2009 | Gustavsson | |
| 7,811,418 | B2 | 10/2010 | Klerelid et al. | |
| 8,911,594 | B2 * | 12/2014 | Gustavsson | D21F 3/0281 162/358.3 |
| 9,057,157 | B2 * | 6/2015 | Gustavsson | D21F 3/0281 |
| 9,181,655 | B2 * | 11/2015 | Gustavsson | D21F 3/0281 |
| 9,410,287 | B2 * | 8/2016 | Gustavsson | D21F 3/0281 |
| 10,472,768 | B1 * | 11/2019 | Poikolainen | D21F 11/14 |
| 2002/0179269 | A1 * | 12/2002 | Klerelid | D21F 5/182 162/206 |
| 2005/0167066 | A1 | 8/2005 | Herman et al. | |
| 2014/0000829 | A1 * | 1/2014 | Gorrel | D21F 3/06 162/358.3 |
| 2014/0238627 | A1 * | 8/2014 | Super | D21H 27/02 162/113 |
| 2014/0284012 | A1 * | 9/2014 | Gustavsson | D21F 3/0281 162/206 |
| 2015/0060000 | A1 * | 3/2015 | Gustavsson | D21F 11/14 162/358.3 |
| 2015/0233054 | A1 * | 8/2015 | Gustavsson | D21F 3/0281 162/116 |
| 2018/0119353 | A1 * | 5/2018 | Tolfsson | D21H 27/005 |
| 2019/0284761 | A1 * | 9/2019 | Tolfsson | D21F 11/002 |
| 2019/0316296 | A1 * | 10/2019 | Tolfsson | D21F 3/0281 |
| 2019/0360154 | A1 * | 11/2019 | Eagles | D21F 7/083 |

FOREIGN PATENT DOCUMENTS

| | | | | |
|---|---|---|---|---|
| EP | 2737125 | B1 | 3/2016 | |
| EP | 2963176 | B1 | 3/2018 | |
| WO | WO-2018114467 | A1 * | 6/2018 | D21F 3/0281 |

* cited by examiner

METHOD FOR MAKING TISSUE PAPER

CROSS REFERENCE TO RELATED APPLICATIONS

This application is a National Stage Application, filed under 35 U.S.C. § 371, of International Application No. PCT/EP2017/082369, filed Dec. 12, 2017, which claims priority to Swedish Application No. 1651680-9, filed Dec. 19, 2016; the contents of both of which as are hereby incorporated by reference in their entirety.

BACKGROUND

Related Field

The present invention relates to a method for making tissue paper.

Description of Related Art

In machines and methods of making tissue paper, a structured/textured fabric may be used to imprint a three-dimensional pattern into the tissue paper web in order to increase the bulk of the fibrous web (i.e. the tissue paper web). One way of doing this is to use so called through-air drying, often referred to as TAD, in which the fibrous web is carried during a part of the manufacturing process by a foraminous wire that imprints a three-dimensional pattern into the fibrous web. The foraminous wire which is commonly referred to as a TAD wire is arranged to carry the fibrous web over one or several through-air drying cylinders (TAD cylinders). An example of a machine using through-air drying is disclosed in, for example, U.S. Pat. No. 6,398,916. In U.S. Pat. No. 6,398,916, it is disclosed that the fibrous web may be transferred to a Yankee drying cylinder after it has been dried on one or two TAD cylinders. As an alternative to TAD technology, it has been suggested that a structured/textured belt be used that passes together with the fibrous web through a press nip after which the fibrous web is transferred to a Yankee drying cylinder. An example of such a technology is disclosed in, for example, U.S. Pat. No. 6,547,924. Another example of how a structured/textured belt may be used is disclosed in U.S. Pat. No. 7,811,418. European patent No. 2,737,125 discloses a method and a machine in which a fibrous web is formed in a former and conveyed to a Yankee drying cylinder and transferred to the Yankee drying cylinder in a transfer nip. A belt which may be a textured belt or a smooth belt is passed through the transfer nip. In the transfer nip, a shoe roll may be used which has a flexible support body and a flexible jacket. It is stated that the length of the transfer nip may be in the range of 30 mm-100 mm and that the transfer nip may be operated at a linear load which is in the range of, for example, 50 kN/m-100 kN/m. It is stated that a suitable highest pressure in the transfer nip may be 1 MPa-3 MPa and that, in one embodiment, the highest pressure may be 2 MPa. It is also stated that the inventors believe that higher pressures could result in better adhesion of the web to the Yankee drying cylinder and that peak pressures up to 6 MPa or even higher may be tested.

Methods and machines in which a tissue paper web is transferred in a non-dewatering transfer nip to a Yankee drying cylinder are used in particular when the web has been previously subjected to some form of texturing or structuring by a texturing/structuring fabric such as a TAD wire but can also be employed in machines without texturing fabrics.

The object of the invention is to provide a method for making tissue paper in which the fibrous web is transferred to a Yankee drying cylinder in a non-dewatering transfer nip and in which a high quality of the tissue paper is achieved and a reliable web transfer to the Yankee drying cylinder.

BRIEF SUMMARY

The invention relates to a method of making tissue paper in which a fibrous web is formed in a forming section and transferred to a Yankee drying cylinder in a non-dewatering transfer nip formed between the Yankee drying cylinder and a shoe roll. The Yankee drying cylinder has a cylindrical outer surface and is arranged to be rotatable about an axis of rotation. The shoe roll further comprises a rotatable flexible jacket that is arranged to run in a loop around the shoe. A carrier fabric forms a loop around the shoe roll and the carrier fabric has at least one structured/textured side that contacts the fibrous web such that a three-dimensional pattern is imprinted into the fibrous web. In the context of this patent application, the term "structured" as well as the term "textured" refer to a surface that is not smooth but has a surface that is three-dimensional, for example a surface divided into crests and valleys or a surface having land areas separated from each other by depressions, cavities or through-holes through the fabric such that the carrier fabric can be used to imprint a three-dimensional structure into a fibrous web. The carrier fabric is a fabric that does not absorb water and the textured side of the carrier fabric has land areas separated from each other by open areas. The open areas can be depressions in the carrier fabric or through-holes in the carrier fabric. The carrier fabric carries the fibrous web to the transfer nip. In the transfer nip, the fibrous web is transferred from the carrier fabric to the cylindrical outer surface of the Yankee drying cylinder on which the fibrous web is dried. A doctor blade crepes the dried fibrous web from the cylindrical outer surface of the Yankee drying cylinder. A coating is sprayed onto the cylindrical outer surface of the Yankee drying cylinder at a location between the transfer nip and the doctor blade such that the cylindrical outer surface of the Yankee drying cylinder is covered by a thin film of coating. The inventive method comprises forming the transfer nip between the shoe and the cylindrical outer surface of the Yankee drying cylinder. The length of the transfer nip in the circumferential direction of the Yankee drying cylinder is in the range of 30 mm-100 mm, preferably 50 mm-100 mm. According to the invention, the linear load is selected such that the peak pressure in the transfer nip lies in the range of 2 MPa-8 MPa, preferably 4 MPa-8 MPa and even more preferred 5 MPa-7 MPa when the pressure in the transfer nip is defined as the linear load in the transfer nip divided by the total land area of the carrier fabric in the nip, i.e. the sum of the land areas that are actually in the nip at a given moment.

For example, the linear load in the transfer nip may be in the range of 35 kN/m-120 kN/m depending on available land area.

In advantageous embodiments of the invention, the shoe roll comprises a shoe that is deformable such that it can adapt to the cylindrical outer surface of the Yankee drying cylinder. A suitable shoe may thus be made of an elastic material. However, embodiments are conceivable in which the shoe roll comprises a shoe that is made of a stiffer material For example, the shoe could be made of steel or aluminum.

In embodiments of the invention, the pressure profile in the transfer nip is shaped such that the peak pressure in the transfer nip does not exceed the average pressure in the transfer nip by more than 75% and preferably not by more than 60%.

In embodiments of the invention, the peak pressure in the transfer nip does not exceed the average pressure in the transfer nip by more than 60% and preferable not by more than 50%.

In embodiments of the inventive method, the fibrous web is first dried on at least one through-air drying cylinder and subsequently transferred to the Yankee drying cylinder and the linear load in the transfer nip may then be in the range of 35 kN/m-45 kN/m.

In some embodiments of the invention, the Yankee drying cylinder is the first drying cylinder on which the fibrous web is dried. In such embodiments, the linear load in the transfer nip may advantageously (but not necessarily) be in the range of 65 kN/m-95 kN/m, preferably 70 kN/m-90 kN/m.

In some advantageous embodiments of the invention, the pressure in the transfer nip may be so distributed that the pressure follows a pressure curve from an entry point of the transfer nip to an exit point of the transfer nip and in which the pressure curve has a saddle point located between two points with higher pressure.

In many realistic embodiments of the invention, the tissue paper may have a basis weight in the range of 12 $g/m^2$-30 $g/m^2$ when it leaves the Yankee drying cylinder. However, basis weights above 30 $g/m^2$ are also conceivable, for example basis weights up to 35 $g/m^2$.

In preferred embodiments of the invention, the fibrous web is brought into contact with a textured fabric such that a three-dimensional pattern is imprinted into the fibrous web before the fibrous web is transferred to the Yankee drying cylinder,

DETAILED DESCRIPTION OF VARIOUS EMBODIMENTS

The inventors of the present invention have discovered that, when a fibrous web is transferred in a non-dewatering transfer nip to a Yankee drying cylinder, the web may become damaged. This problem may occur when a smooth belt is used in the transfer nip and the web has not been subjected to any texturing treatment such as TAD. However, the problem can be especially pronounced when the fibrous web that is transferred to the Yankee drying cylinder is in contact with a textured/structured fabric such as a TAD wire or a textured belt which passes the transfer nip together with the fibrous web. In the context of this patent application, both the term "structured" and the term "textured" refer to a surface that is not smooth but has a surface that is three-dimensional, for example a surface divided into crests/ridges and valleys or a surface having land areas separated from each other by depressions, cavities or through-holes through the fabric such that the carrier fabric can be used to imprint a three-dimensional structure into a fibrous web. The texturing (the three-dimensional pattern imprinted in the web) may become damaged during transfer in the transfer nip. It is an object of the present invention to achieve a reliable web transfer to the Yankee drying cylinder while avoiding or at least reducing damage to the fibrous web.

One object of the present invention is to eliminate or reduce such damage to the fibrous web that may occur in the transfer nip.

Figure 1:
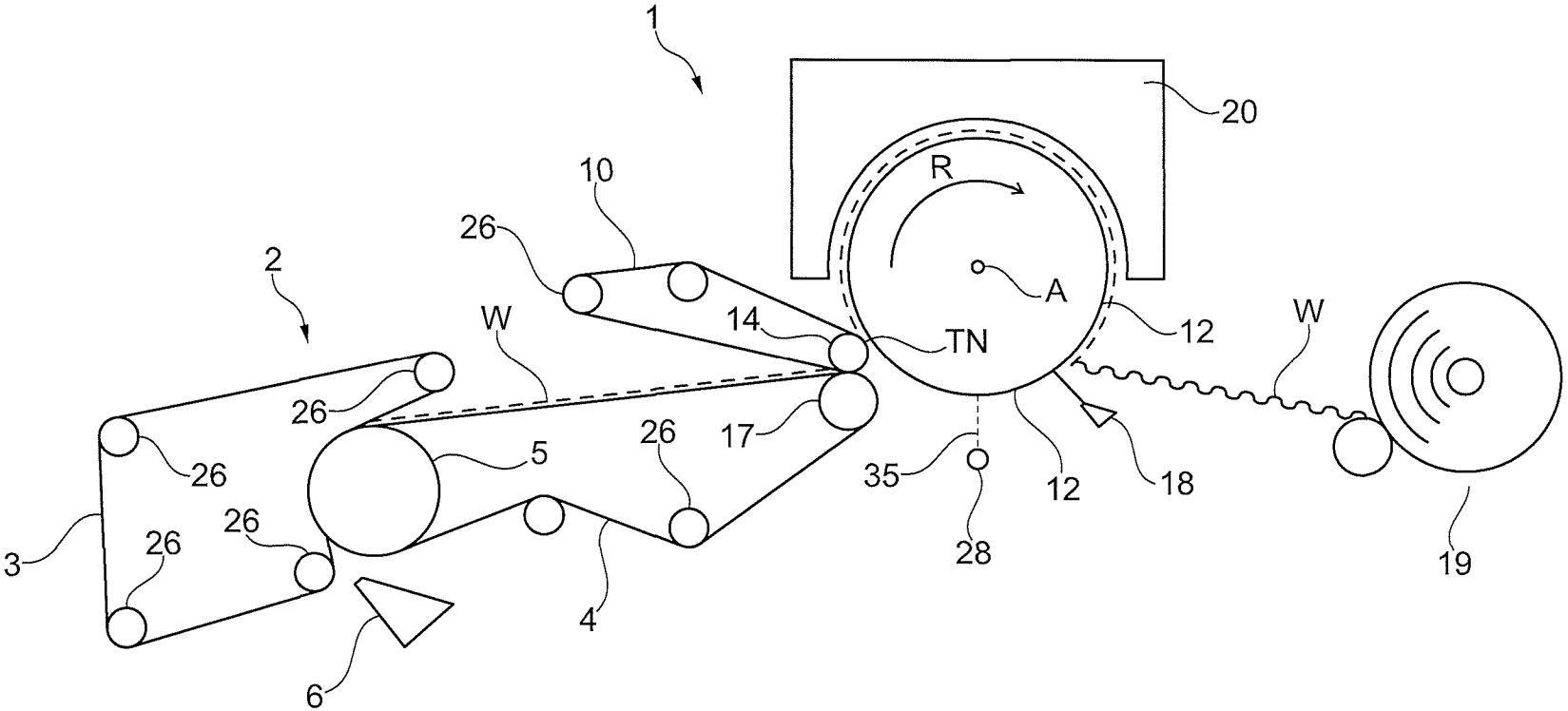
FIG. 1 is a side view of a first embodiment of a machine and a method according to the present invention.

Reference will now be made to FIG. 1 in which a method and a machine are schematically indicated. A forming section 2 comprises a head box 6, a first forming fabric 3, a second forming fabric 4 and a forming roll 6. The forming fabrics 3, 4 are suitable guided by guide rolls 26 such that each forming fabric 3, 4 runs in a loop. The forming fabrics 3, 4 may be forming wires. It may also be so that other forming fabrics are used. For example, it may be so that only the first forming fabric 3 is a forming wire while the second forming fabric 4 is a water-receiving felt. It should be understood that the particular layout of the forming section 2 that is shown in FIG. 1 is only an example of a. possible forming. section and that the layout could take other forms. After the fibrous web W has been formed in the forming section 2, it is transferred to a Yankee drying cylinder 12. The Yankee drying cylinder 12 has a cylindrical outer surface 13 and it is arranged to be rotatable about an axis of rotation A. The direction of rotation during operation is indicated by the arrow "R". The Yankee drying cylinder 12 may be, for example, a cast iron Yankee drying cylinder but it may also be, for example, a Yankee drying cylinder as disclosed in EP 2126203 B1.

The Yankee drying cylinder 12 may advantageously—but not necessarily—have a Yankee drying hood 20, for example as Yankee drying hood as disclosed in EP 2963176 A1.

Figure 2:
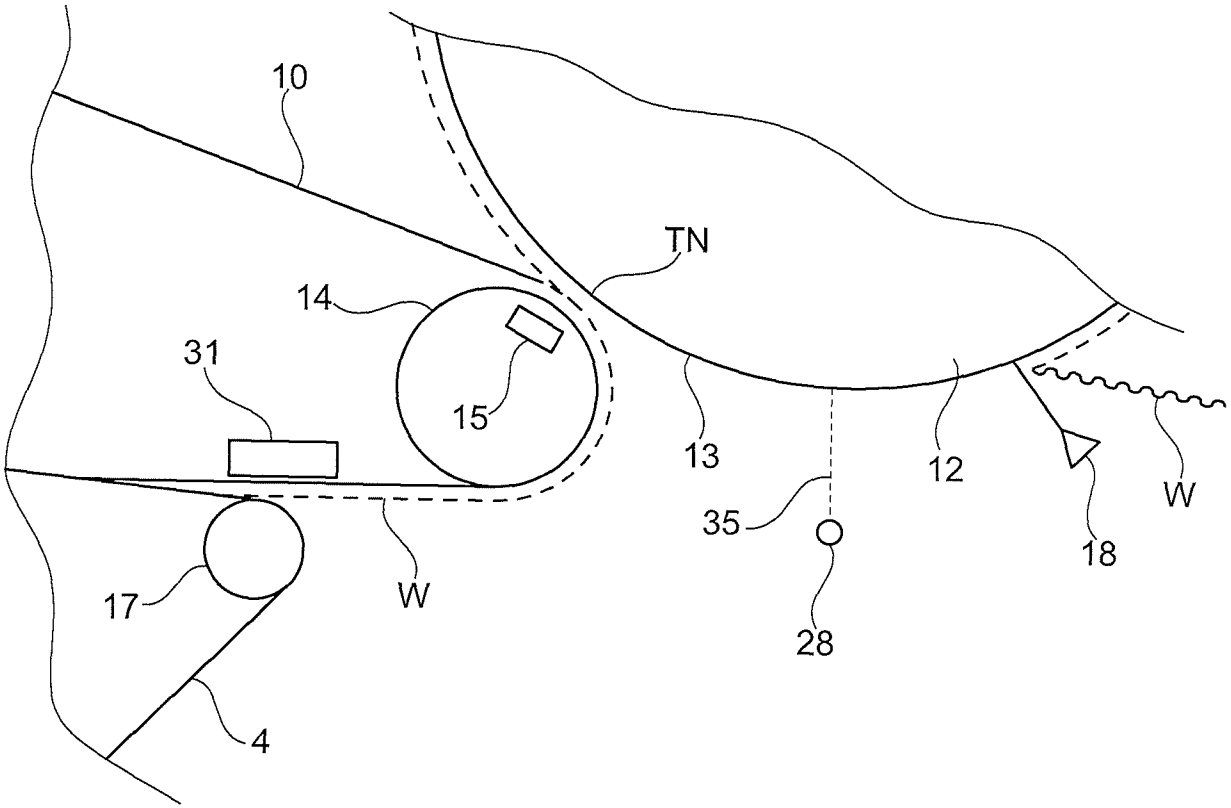
FIG. 2 is a side view of an embodiment slightly different from the embodiment of FIG. 1.
Figure 3:
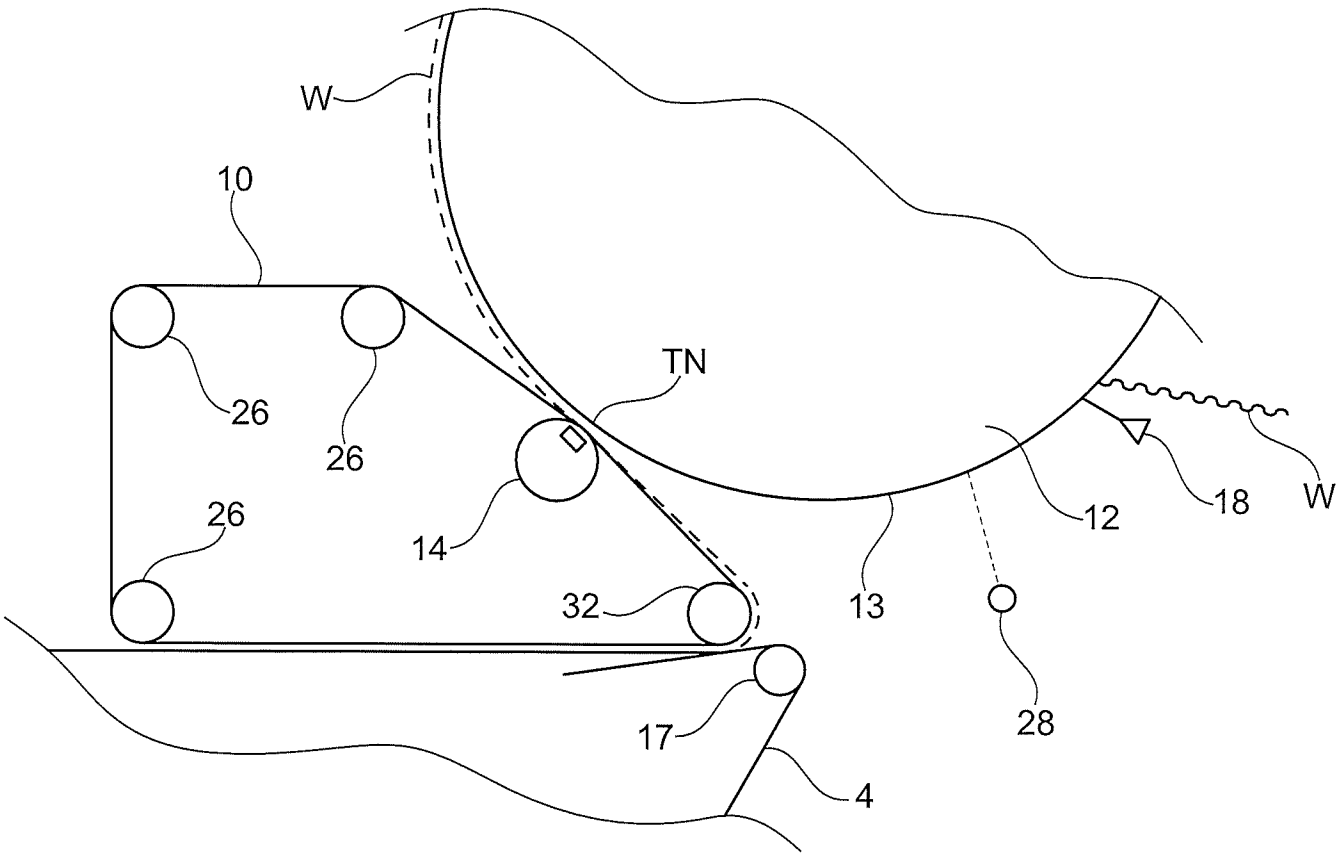
FIG. 3 is a view similar to FIG. 2 but showing yet another embodiment.

A spraying device 28 is arranged to apply a chemical coating onto the cylindrical outer surface 13 of the Yankee drying cylinder 12. The spraying device 28 is preferably capable of spraying a chemical coating over the entire width of the Yankee drying cylinder 12. The spraying device 28 may be designed as disclosed in, for example, U.S. Pat. No. 7,493,012 but other designs are also conceivable. In FIGS. 1, 2 and 3, the reference numeral 35 indicates a stream or jet of fluid chemical coating going from the spraying device 28 to the cylindrical outer surface 13 of the Yankee drying cylinder 12. The purpose of the coating may in particular be to improve adhesion of the fibrous web W to the cylindrical outer surface 13 of the Yankee drying cylinder 12 and the chemical coating may thus comprise adhesives. Other purposes of the coating may include protection of the cylindrical outer surface from wear.

Figure 6:
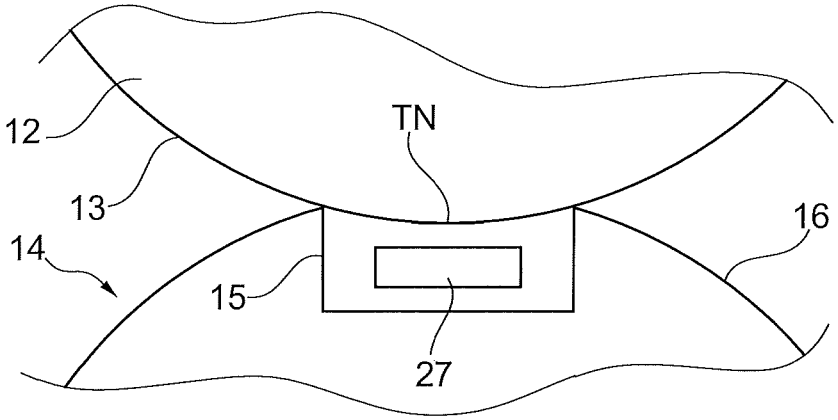
FIG. 6 is a cross-sectional view of a possible embodiment of the transfer nip.
Figure 7:
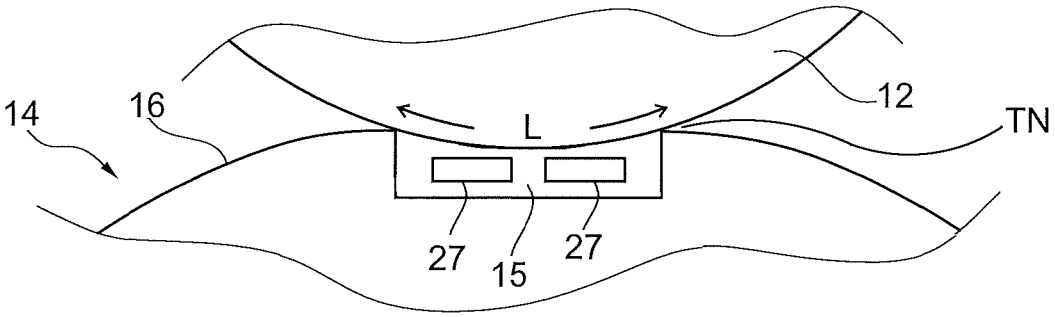
FIG. 7 is a cross-sectional view of another possible embodiment of the transfer nip.

The transfer of the fibrous web W to the Yankee drying cylinder 12 is made in a non-dewatering transfer nip TN that is formed between the Yankee drying cylinder 12 and a shoe roll 14 (see FIGS. 6-7). The shoe roll 14 comprises a shoe 15 that is arranged to act against the Yankee drying cylinder 12. The shoe roil 14 further comprises a rotatable flexible jacket 16 (see FIGS. 6-7) that is arranged to run in a loop around the shoe 15. A carrier fabric 10 loops the shoe roll 14 (i.e., the carrier fabric runs in a loop/forms a loop and the shoe roll 14 is located inside the loop formed by the carrier fabric 10) and the carrier fabric 10 has at least one side that is textured and is arranged to contact the fibrous web W such that a three-dimensional pattern is imprinted into the fibrous web W. The three-dimensional pattern may in particular be imprinted into the fibrous web W in We transfer nip TN bin imprinting may optionally also be carried out in a nip preceding the transfer nip TN. The carrier fabric is a fabric that does not absorb water and the textured side of the carrier fabric has land areas separated from each other by open areas. The open areas can be depressions in the carrier fabric or through-holes in the carder fabric.

In preferred embodiments of the invention, the shoe 15 of the shoe roll 14 is a shoe that is deformable such that it can adapt to the cylindrical outer surface 13 of the Yankee drying cylinder 12. Such a deformable shoe 15 may be made of an elastic material such as rubber or a material that has properties similar to rubber.

Figure 11:
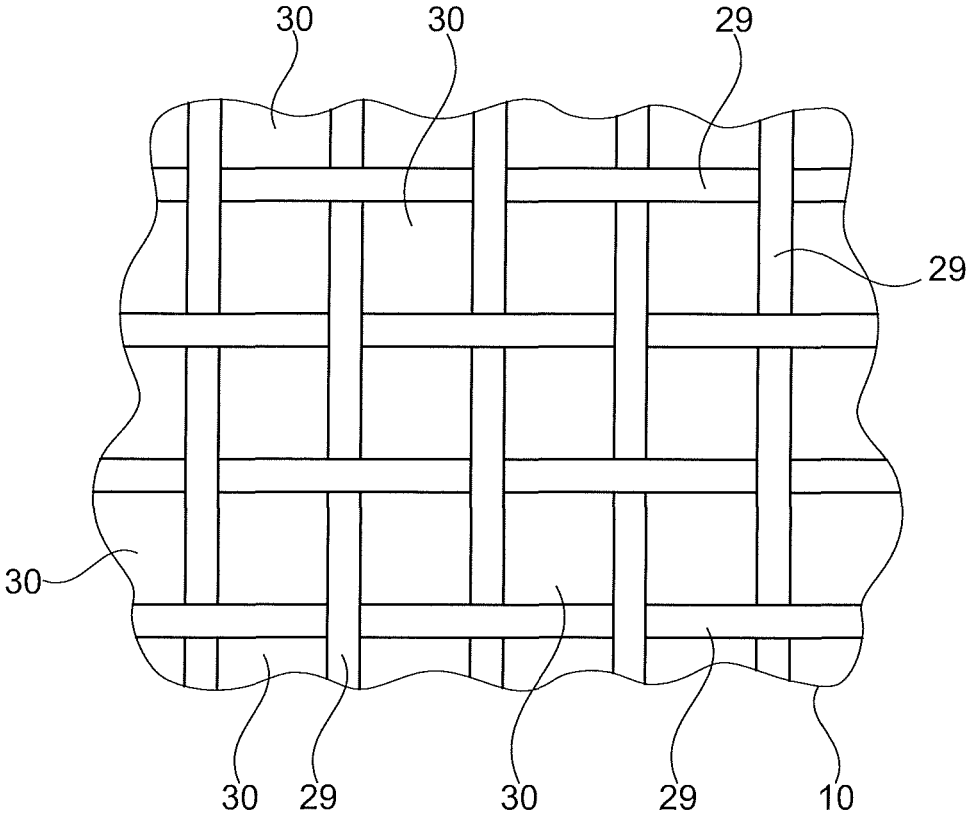
FIG. 11 is a schematic representation of the textured surface of a carrier fabric that may be used in the present invention.

Two examples of possible carrier fabrics will now be briefly discussed with reference to FIG. 11, FIG. 12 and FIG. 13. With reference to FIG. 11, a carrier fabric 10 may be an open wire intended for use in a through air drying (TAD) machine. In the embodiment of FIG. 2, the carrier fabric 10 may be such a fabric. With continued reference to FIG. 11, the carrier fabric 10 has land areas 29 formed by solid material and void areas 30 formed by through-holes in the wire. When the carrier fabric 10 is pressed against the Yankee drying cylinder 12 in the transfer nip TN, only the land areas 29 will be able to receive the force of the linear load in the transfer nip TN, the void areas 30 cannot carry any load. The pressure in the transfer nip will therefore be distributed over the land areas 29 that are in the transfer nip TN. If the pressure acting on the land. areas 29 is too high, the land areas may be pressed through the fibrous web W and into the layer of coating and this must be avoided. The peak pressure, as influenced or defined by the linear load divided by the effective area of the carrier fabric 9 (i.e. the land areas 29) must therefore be controlled such that, dependent upon the applied force due to the linear load, the pressure remains within predetermined limits.

Figure 12:
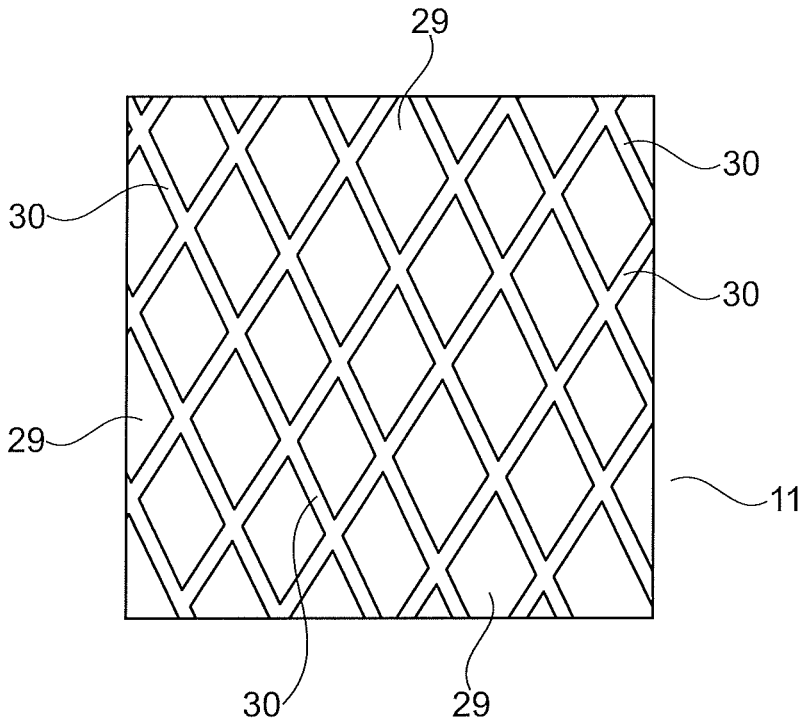
FIG. 12 is a schematic representation of another textured surface of a carrier fabric that may be used in the present invention.

Reference will now be made to FIG. 12 and to FIG. 13 that show a carrier fabric 10 that has a base layer 40 which will not contact the fibrous web W. The base layer 40 may be permeable to air but may optionally also be impermeable to air. A textured side of the carrier fabric 10 has land areas 29 and open areas 30. When the carrier fabric 10 is pressed against the Yankee drying cylinder 12 in the transfer nip TN, only the land areas 29 will be able to receive the force of the linear load in the transfer nip TN, the void areas 30 cannot carry any load. Just as in the embodiment of FIG. 11, the peak pressure as defined by the linear load divided by the effective area of the carrier fabric 9 (i.e. the land areas 29) must therefore be controlled such that it remains within predetermined limits.

Figure 13:
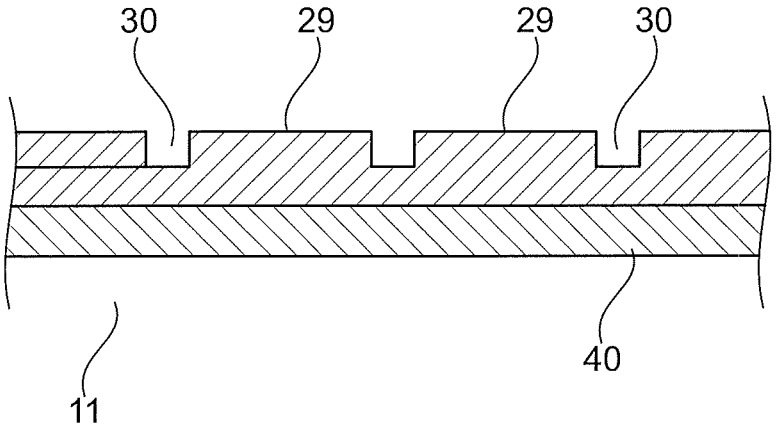
FIG. 13 is a schematic representation corresponding to FIG. 12 but showing the carrier fabric in cross section.

It should be understood that the embodiments of FIG. 11 and FIGS. 12 and 13 are only examples of how a structured/textured carrier fabric 10 may be designed and that the carrier fabric 10 may take many other different forms. The land areas 29 of that surface of the carrier fabric 10 that faces the fibrous web W may constitute 15%-90% of the total surface area facing the fibrous web W.

It may be added that, while the terms "structured" and "textured" are treated as synonymous in the context of this patent application, the term "textured" is often used in particular for the kind of carrier fabric disclosed in FIGS. 12 and 13. However, the effect in both cases is to achieve the technical effect that a three-dimensional structure is imprinted into the fibrous web W.

The three-dimensional pattern can be imprinted into the fibrous web, for example, as the fibrous web W passes through the transfer nip TN together with the carrier fabric 10 and possibly also in a nip formed between the shoe roll 14 and another roll 17 (which would require that the shoe roll 14 has a shoe facing the roll 17 in FIG. 1). With reference to FIG. 1, the roll 17 may be a roll forming a nip with the shoe roll 14 but it may also be merely a guide roll that does not form any nip with the shoe roll 14. The inventive method comprises forming the transfer nip TN between the shoe 15 and the cylindrical outer surface 13 of the Yankee drying cylinder 12. The length L of the transfer nip TN in the circumferential direction of the Yankee drying cylinder 12 (for the length L, see FIG. 7) is in the range of 30 mm-100 mm, preferably 50 mm-100 mm.

In many realistic embodiments, the linear load in the transfer nip TN may be in the range of 35 kN/m-120 kN/m.

To ensure that the fibrous web W really adheres to the cylindrical outer surface 13, the pressure in the transfer nip TN should reach a certain level to pressure level. However, the structured/textured carrier fabric 10 is facing the fibrous web W in the transfer nip TN. If the peak pressure in the transfer nip TN becomes too high, the pressure from the land areas of the carrier fabric may go through the fibrous web and, in the worst case, also through the layer of chemical coating that has been applied by the spraying device 28 and to the outer surface 13 of the Yankee drying cylinder 12. This can be detrimental both to the fibrous web W and to the web transfer in the transfer nip TN.

With reference to FIGS. 11-12, when the carrier fabric is a fabric that has a structured/textured surface facing the fibrous web W, the pressure acting on the carrier fabric will he distributed over the land areas 29 of the carder fabric 10 while the open areas 30 will he incapable of taking any of the pressure resulting from the linear load in the transfer nip, at least not to any significant extent.

The inventors have now found that the peak pressure in the transfer nip TN should be kept in the range of 2 MPa-8 MPa and preferably 4 MPa-8 MPa. In this context, the pressure in the transfer nip should be understood as being the linear load divided by the sum of the land areas 29 that are in the transfer nip TN at a given moment (and faces the web W), i.e. the total land area of the carrier fabric 10 that is actually in the transfer nip TN in a given moment. If the pressure in the transfer nip is calculated without taking effective area (land area) into account, the pressure would simply be the total area of the carrier fabric facing the fibrous web W. However, the inventors have found that it is necessary to compensate for the fact that the available land area is less than 100%. For example, let's assume that the actual land area (the sum of the land areas divided by total carrier fabric area) is only 50% and that, if no compensation is made for actual land area, the average pressure in a specific case is 3 MPa and the peak pressure 7 MPa. If the actual land area is taken into account, the average pressure will be 6 MPa and the peak pressure will be 14 MPa. The inventors have found that, when the peak pressure (as compensated for actual land area) is in the range of 2 MPa-8 MPa, the web transfer to the outer surface 13 of the Yankee drying cylinder 12 will be reliable and the risk that the land areas 29 will penetrate too far is eliminated or at least significantly reduced. It should be understood that, "the total land area" in the transfer nip refers to the land area of that surface of the carrier fabric 10 that faces the fibrous web.

In advantageous embodiments of the inventive method, the pressure curve, i.e. the distribution of pressure in the transfer nip, may be such that the peak pressure in the transfer nip TN does not exceed the average pressure in the transfer nip TN by more than 75% and preferably not by more than 60%. The inventors have found that such a relatively even pressure distribution tends reduce damage to the fibrous web W, in particular damage to the pattern imprinted into the fibrous web W.

With reference to FIGS. 6-7 if the shoe 15 is a deformable shoe, this entails the advantage that the shoe 1 can adapt to different profiles of the Yankee drying cylinder 12 and to variations in the cross machined direction of the diameter of the Yankee drying cylinder 12 and this improves the transfer function.

In a shoe press, the pressure profile is normally not symmetrical but instead devised such that the pressure rises towards a pressure peak near the end of the nip. In this way, the peak pressure in the nip is usually considerably higher than the average pressure. The inventors of the present invention have now found that, when the peak pressure in a non-dewatering transfer nip is much higher than the average pressure in the transfer nip, this tends to result in damage to the fibrous web, particularly in the fibrous web is textured. Therefore, the inventors have also found that, preferably, the peak pressure in the transfer nip TN should not exceed average pressure by more than 75% and preferably not by more than 60%. Even more preferred, the peak pressure in the transfer nip TN does not exceed the average pressure in the transfer nip TN by more than 50%.

In the embodiment of FIG. 1, the newly formed fibrous web W is carried on the forming fabric 4 to a nip between a counter roll 17 and a shoe roll 14. A carrier fabric 10 that may be a belt passes through the nip and picks the fibrous web W from the forming fabric 4 and transfers the web W to the cylindrical outer surface 13 of the Yankee drying cylinder 12. The transfer of the web W to the Yankee cylindrical outer surface 13 of the Yankee drying cylinder 12 takes place in a transfer nip TN. It should be understood that the counter roll 17 is optional. The roll 17 in FIG. 1 does not necessarily form a nip with the roll 14 but could be simply a guide roll.

In the embodiment of FIG. 1, the carrier fabric 10 may in particular be a textured/structured belt, i.e. a belt that contacts the fibrous web with a textured/structured surface such that it capable of imprinting a three-dimensional structure into the fibrous web.

Many variations of the layout of FIG. 1 are conceivable. For example, the newly formed fibrous web W could be transferred from a forming fabric 3,4 to a textured fabric in a rush transfer arrangement, i.e. an arrangement where the fibrous web is "wet creped" by means of a speed difference between the fabrics and in which the fibrous web is subsequently transferred to the cylindrical outer surface 13 of the Yankee drying cylinder 12.

One variation of the layout of FIG. 1 is shown in FIG. 2. In the embodiment of FIG. 2, the fibrous web W is travelling sandwiched between a forming fabric 4 that may be a water-absorbing felt and a carrier fabric 10 that may be a wire that is permeable to air. When the forming fabric 4 has passed a guide roll 17, the forming fabric is guided away from the carrier fabric 10. A suction device such as a suction box 31 (or a suction roll) may be arranged inside the loop of the carrier fabric 10 to ensure that the fibrous web follows the carrier fabric 10 and not the forming fabric 4. The suction device may be placed in the area opposite the guide roll 17. In the embodiment of FIG. 2, the carrier fabric 10 is made to wrap the shoe roll 14 and the wrap angle may be in the range of, for example, 45°-180°. If the carrier fabric 10 that loops the shoe roll 14 also wraps the shoe roll 14 for more than 45°, this entails the advantage that the path of the carrier fabric 10 can be very precisely defined.

In FIG. 3, an embodiment is shown that differs from that of FIG. 2 in that the carrier fabric 10 is separated from the forming fabric 4 before the forming fabric 4 has reached the guide roll 17. A suction roll 32 placed inside the loop of the carrier fabric 10 ensures that the web W follows the carrier fabric 10 and not the forming fabric 4. Unlike the embodiment of FIG. 2, the carrier fabric 10 that loops the shoe roll 14 hardly wraps the shoe roll 14 at all except when the carrier fabric 10 passes through the transfer nip TN. The suction roll 32 serves as a guide roll that guides the carrier fabric 10 to the transfer nip TN. The reference numerals 26 in FIG. 3 indicate guide rolls. The carrier fabric 10 that loops the shoe roll 14 may thus be guided through the transfer nip TN in such a way that it wraps the shoe roll 14 only as it passes through the transfer nip TN. Such embodiments entail the advantage that a greater part of the shoe roll 14 becomes available for cleaning operations if cleaning operations are judged necessary (for example by sprinkling water on the jacket 6 of the shoe roll 14 to remove dirt).

With reference to FIG. 6 and FIG. 7, the shoe roll 14 has a shoe 15 that is deformable such that it can adapt to the cylindrical outer surface 13 of the Yankee drying cylinder 12 and the shoe roll 14 has a flexible jacket 16. The flexible jacket 16 may be made of polyurethane or a material that comprises polyurethane or has properties similar to polyurethane. The shoe roll 14 may optionally be designed as disclosed in U.S. Pat. No. 7,527,708 but other designs are conceivable as long as the shoe can be pressed against the Yankee drying cylinder and deform to adapt to the outer shape of the Yankee drying cylinder. For example, the shoe roll 14 could be designed as disclosed in EP 2085513. In the embodiments of FIG. 6 and FIG. 7, the shoe 15 is a shoe made of an elastically deformable material and has one or several internal cavities 27 that can be filled with a pressurized fluid such that the shoe expands 15 such that the transfer nip TN can he closed. For example, the shoe 15 may have two or more cavities that can be filled with a pressurized fluid. This is described in U.S. Pat. No. 7,527,708 and reference is made to that document for a more detailed explanation.

Before the fibrous web W is transferred to the Yankee drying cylinder 12, the fibrous web W is preferably brought into contact with a carrier fabric 10 (see FIG that is a structured/textured fibric such that a three-dimensional pattern is imprinted into the fibrous web W.

In the embodiment of FIG. 1, the carrier fabric 10 that passes through the transfer nip TN may be a textured/structured belt that has at least one side that is textured and faces the fibrous web W and imprints a three-dimensional pattern into the surface of the fibrous web W. The carrier fabric 10 may be an impermeable or substantially impermeable textured belt. For example, it could be a structured/textured belt as disclosed in U.S. Pat. No. 6,547,924 such that the bulk of the fibrous web is improved when the carrier fabric 10 imparts a three-dimensional structure to the fibrous web as the carrier fabric 10 passes together with the fibrous web W through the transfer nip TN and/or a nip with a counter roll 17.

In the embodiment of FIG. 1, the Yankee drying cylinder 12 is the first drying cylinder on which the fibrous web W is dried. In such embodiments, the inventors have found that a suitable linear load in the transfer nip TN may be in the range of 65 kN/m-95 kN/m, preferably 70 kN/m-90 kN/m.

After having been dried on the Yankee drying cylinder 12 that is normally heated internally by hot steam, the fibrous web W can be creped off from the cylindrical surface 13 of the Yankee drying cylinder 12 by a doctor 18 and be sent forward to a reel-up 19. The reel-up 19 which is only schematically indicated may be any reel-up suitable for a tissue web. For example, it could be a reel-up of the kind disclosed in U.S. Pat. No. 5,845,868 or U.S. Pat. No. 5,375,790.

Figure 4:
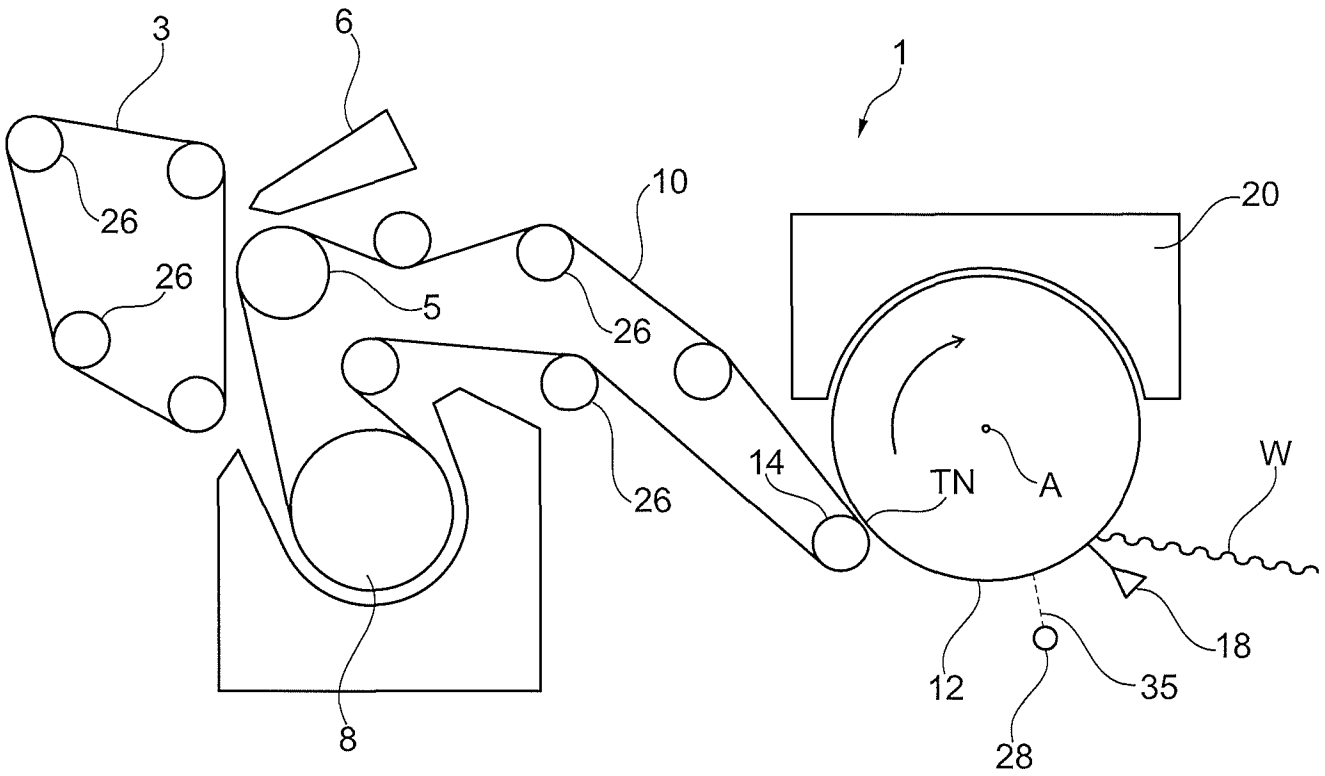
FIG. 4 is a side view of an embodiment in which through-air drying is used.
Figure 5:
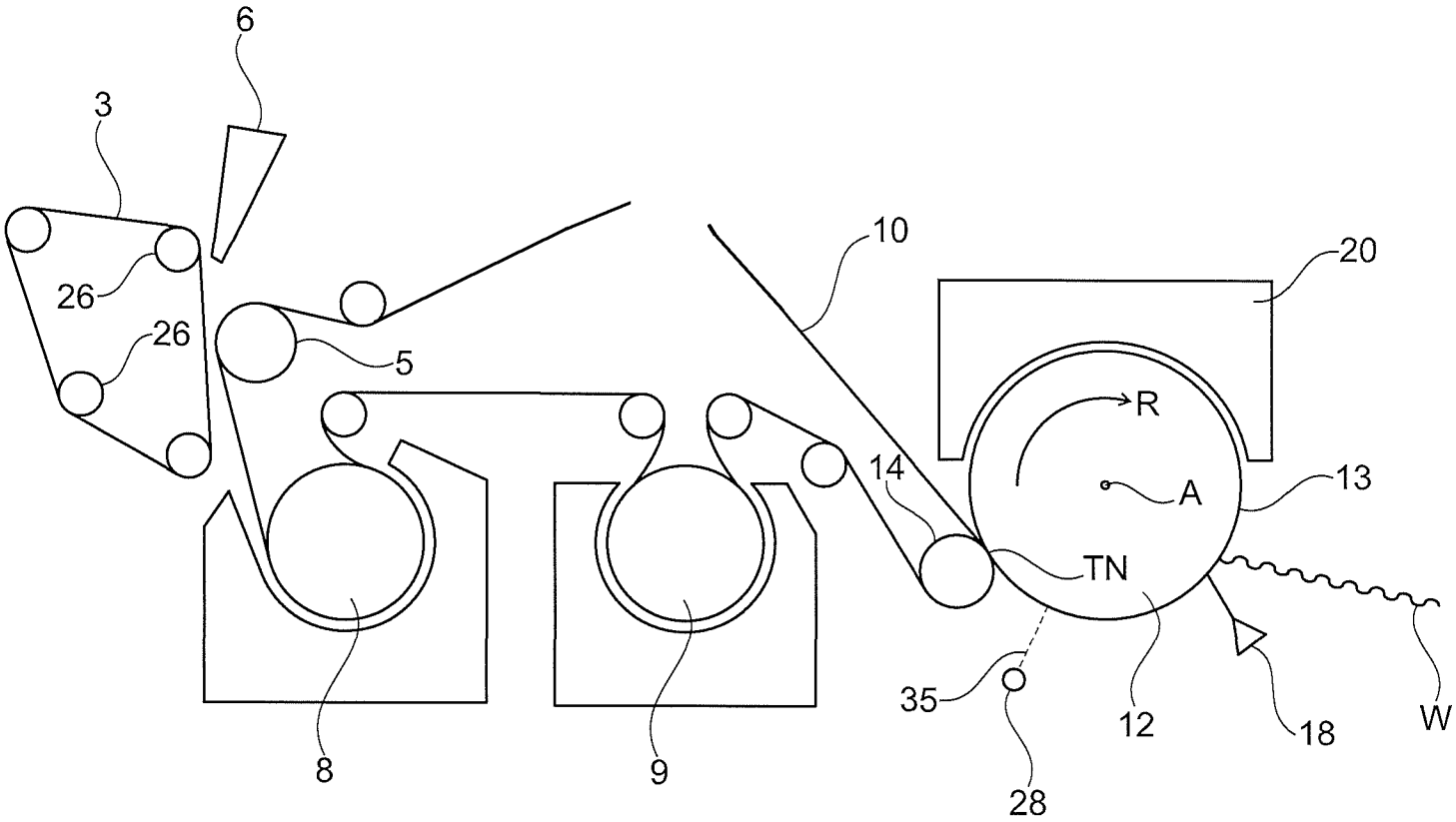
FIG. 5 is a side view of an embodiment in which two through-air drying cylinders are used.

Reference will now be made to FIG. 4 and to FIG. 5. In the embodiments of FIG. 4 and FIG. 5, the fibrous web W is first dried on at least one through-air drying cylinder 8 (or on two or more through-air drying cylinders 8, 9) and subsequently transferred to the Yankee drying cylinder 12. The fibrous web W will then be brought into contact with a carrier fabric 10 in the shape of a TAD wire that is foraminous (permeable to air) and which has a very high capacity for imparting a three-dimensional structure to the fibrous web W. In such methods and machines, the land area 29 of the carrier fabric 10, i.e. the surface area over which the linear load is distributed in the transfer nip TN can be quite small, for example 15%-20% of the total area of the side of the carrier fabric that faces the fibrous web W. For such methods and machines, the inventors have found that the linear load in the transfer nip TN should be correspondingly lower that if the land area constitutes a greater part of the surface area of the carrier fabric. Depending also on nip length, a linear load in the range of 35 kN/m-45 kN/m may be used although other linear loads may optionally be used.

With reference to FIGS. 11-12, in one realistic embodiment contemplated by the inventors, the carrier fabric may be a TAD wire that has a total land area 29 that constitutes 22% of the total carrier fabric surface facing the fibrous web. The length of the transfer nip may be 41 mm and the linear load 45 kN/m. The peak pressure acting on the actual land area in the transfer nip may be about 5 MPa (also dependent on the pressure profile).

Figure 8:
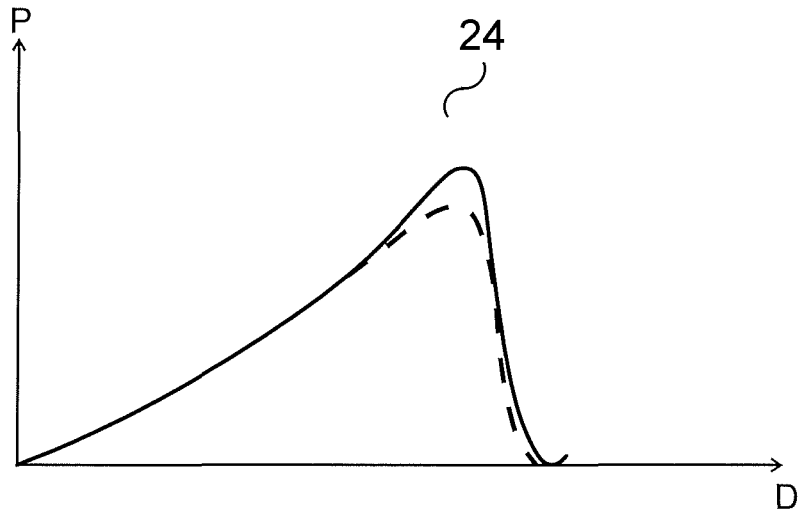
FIG. 8 shows a pressure distribution curve in a shoe press nip.
Figure 9:
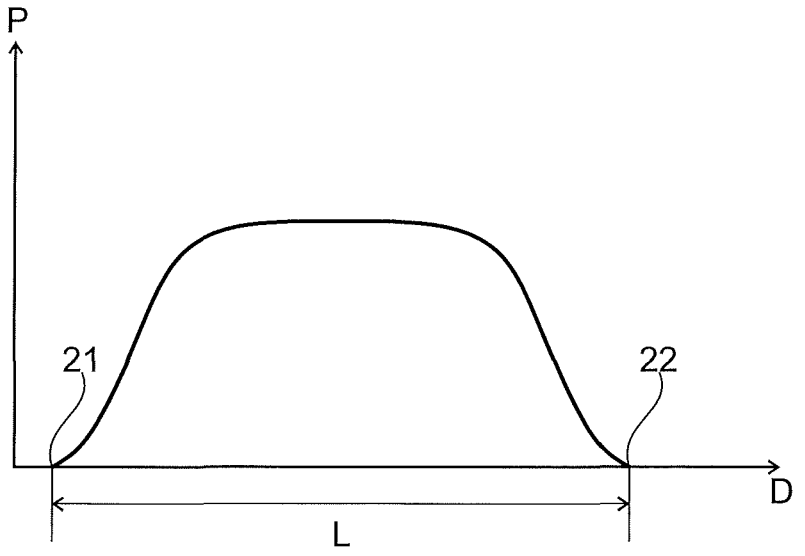
FIG. 9 shows a pressure distribution curve for a transfer nip according to one embodiment of the present invention.

In shoe presses, the pressure is commonly distributed such that the pressure builds up gradually to a sharp maximum at the end of the nip. Such a pressure curve is illustrated in FIG. 8 where the maximum pressure is reached at a pressure peak 24. With such a pressure distribution, the maximum pressure is considerably higher than the average pressure. The inventors of the present invention have discovered that, in a transfer nip against a Yankee drying cylinder, such a pressure distribution may cause damage to the fibrous web W and that this is especially the case when the fibrous web W has been subjected to texturing by a textured/structured fabric. The three-dimensional pattern imparted to the fibrous web may easily become damaged. Therefore, it is preferred that the pressure distribution should instead be more even. The risk of damage to the three-dimensional pattern can then be reduced. FIG. 9 shows a pressure curve in which the pressure is more evenly distributed between an entry point 21 into the transfer nip TN and an exit point 22 (In FIG. 8, FIG. 9 and FIG. 10, "P" represents pressure and "D" represents distance in the nip, i.e. the machine direction of the nip). The inventors have found that a pressure distribution according to FIG. 9 results in less damage to the three-dimensional pattern of the fibrous web than a pressure distribution according to FIG. 8.

Figure 10:
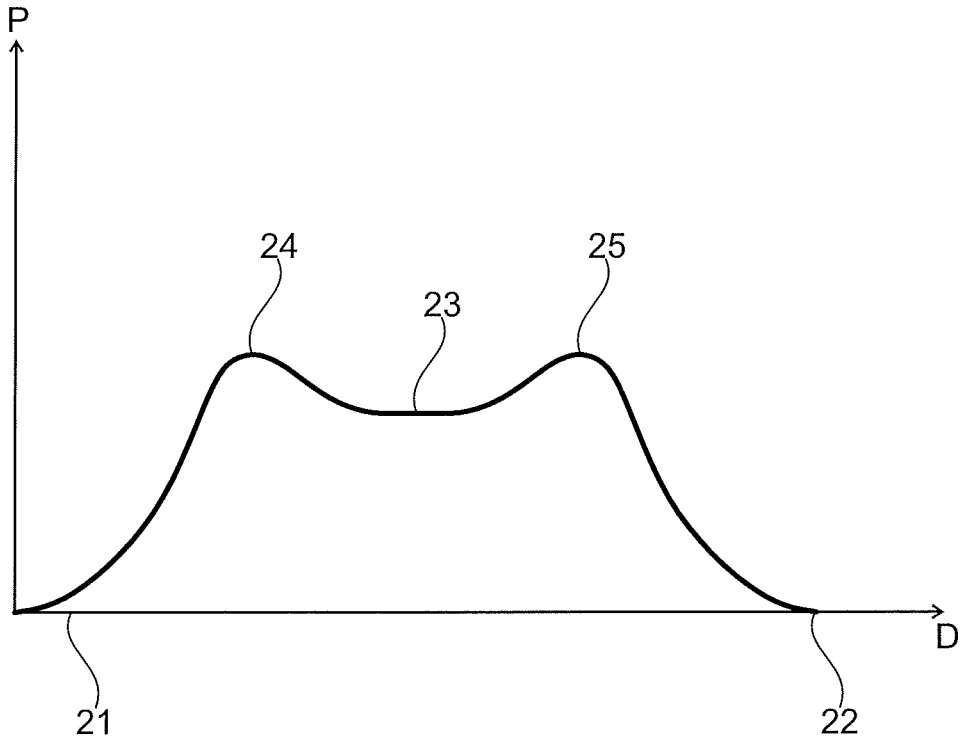
FIG. 10 shows a pressure distribution curve for a transfer nip according to another embodiment of the present invention.

With reference to FIG. 10, an even more advantageous pressure distribution is illustrated. In the pressure curve of FIG. 10, the pressure in the nip is distributed such that there are two pressure peaks 24, 25, i.e. points of higher pressure and a saddle point 23 is located between the peaks 24, 25 with higher pressure, i.e. the pressure in the saddle point 23 is lower than the pressure in the peaks (peak points) 25. The inventors have found that such a pressure distribution curve results in even less damage to the three-dimensional structure of the fibrous web W.

In many practical embodiments, the width of the machine (as defined by, for example, the width of the forming fabrics 3, 4) may be, for example, in the range of 2 m-8 m and typical values could often be in the range of 3 m-6 m.

In many practical cases, the machine may be running at a speed in the range of 1400 m/minute-2000 m/minute but both higher and lower speeds are conceivable. For modern tissue machines, the speed may often be in the range of 1500 m/minute to 1900 m/minute but the general trend is towards higher speeds and, within some years, the present invention may conceivably be operated at speeds up to 2500 m/minute or even higher speeds.

Both surfaces of the carrier fabric 10 may optionally be structured/textured, in particular if the carrier fabric 10 is an open wire such as a TAD wire.

The invention claimed is:

1. A method of making tissue paper in which a fibrous web (W) is formed in a forming section (2) and transferred to a Yankee drying cylinder (12) in a non-dewatering transfer nip (TN) formed between the Yankee drying cylinder (12) and a shoe roll (14), the Yankee drying cylinder (12) having a cylindrical outer surface (13) and being configured to be rotatable about an axis of rotation (A), the shoe roll (14) comprising a shoe (15) that is configured to act against the Yankee drying cylinder (12), and the shoe roll (14) further comprising a rotatable flexible jacket (16) that is configured to run in a loop around the shoe (15), in which method a carrier fabric (10) runs in a loop around the shoe roll (14) and follows the fibrous web (W) into the transfer nip (TN), the carrier fabric (10) having a structured surface facing the fibrous web (W) such that a three-dimensional pattern can be imprinted into the fibrous web (W) by the carrier fabric (10) and the structured surface of the carrier fabric (10) having land areas (29) and open areas (30), wherein the method comprises forming the transfer nip (TN) between the shoe (15) and the cylindrical outer surface (13) of the Yankee drying cylinder (12), wherein the length (L) of the transfer nip (TN) in the circumferential direction of the Yankee drying cylinder (12) is in the range of 30 mm-100 mm, wherein the method further comprises application of a chemical coating on the cylindrical outer surface (13) of the Yankee drying cylinder (12) and creping the fibrous web (W) from the cylindrical outer surface (13) of the Yankee drying cylinder (12), wherein the land areas (29) of the structured surface of the carrier fabric (10) constitute 15%-90% of the total surface area of that side of the carrier fabric (10) that faces the fibrous web (W), and wherein the linear load in the transfer nip is selected such that the peak pressure in the transfer nip (TN) is in the range of 2 MPa-8MPa when the pressure in the transfer nip (TN) is influenced by a relationship between a force of the linear load in the transfer nip (TN) and a sum of the land areas (29) of that part of the carrier fabric (10) that is in the transfer nip (TN) in a given moment.

2. The method according to claim 1, wherein the peak pressure in the transfer nip (TN) does not exceed the average pressure in the transfer nip (TN) by more than 75%.

3. The method according to claim 1, wherein the peak pressure in the transfer nip (TN) does not exceed the average pressure in the transfer nip (TN) by more than 60%.

4. The method according to claim 1, wherein the peak pressure in the transfer nip (TN) does not exceed the average pressure in the transfer nip (TN) by more than 50%.

5. The method according to claim 1, wherein:

the fibrous web (W) is first dried on at least one through-air drying cylinder (8, 9) and subsequently transferred to the Yankee drying cylinder (12), and the linear load in the transfer nip (TN) is in the range of 35 kN/m -45 kN/m.

6. The method according to claim 1, wherein:

the Yankee drying cylinder (12) is the first drying cylinder on which the fibrous web (W) is dried, and the linear load in the transfer nip (TN) is in the range of 65 kN/m -95 kN/m.

7. The method according to claim 1, wherein:

the Yankee drying cylinder (12) is the first drying cylinder on which the fibrous web (W) is dried, and the linear load in the transfer nip (TN) is in the range of 70 kN/m -90 kN/m.

8. The method according to claim 1, wherein:

the pressure in the transfer nip (TN) is so distributed that the pressure follows a pressure curve from an entry point (21) of the transfer nip to an exit point (22) of the transfer nip, and the pressure curve has a saddle point (23) located between two points (24, 25) where the pressure is higher than in the saddle point (23).

9. The method according to claim 1, wherein the tissue paper has a basis weight in the range of 12 $g/m^2$ -30 $g/m^2$ when it leaves the Yankee drying cylinder (12).

10. The method according to claim 1, wherein the shoe (15) of the shoe roll (14) is a deformable shoe (15) that can adapt to the shape of the cylindrical outer surface (13) of the Yankee drying cylinder (12).

* * * * *